US005889430A

United States Patent [19]

Csanky

[11] Patent Number: 5,889,430

[45] Date of Patent: Mar. 30, 1999

[54] CURRENT MODE TRANSISTOR CIRCUIT

[75] Inventor: Geza Csanky, Manhattan Beach, Calif.

[73] Assignee: The Aerospace Corporation, El Segundo, Calif.

[21] Appl. No.: 883,222

[22] Filed: Jun. 26, 1997

[51] Int. Cl.[6] ..... G05F 1/10

[52] U.S. Cl. ..... 327/543; 323/315

[58] Field of Search ..... 327/108, 109, 327/112, 374–377, 379, 389, 391, 427, 434, 437, 538, 541, 543, 544, 546; 326/83; 323/315–317

[56] References Cited

U.S. PATENT DOCUMENTS 4,591,739 5/1986 Nagano ..... 323/315
4,810,902 3/1989 Storti et al. ..... 323/317
5,450,026 9/1995 Morano ..... 326/84
5,525,927 6/1996 Yung et al. ..... 327/543

*Primary Examiner*—My-Trang Nu Ton
*Attorney, Agent, or Firm*—Derrick Michael Reid

[57] ABSTRACT

A current mirror includes a reference transistor connected between the current source and current transistor and receives a reference voltage level and for providing a mirror voltage to a mirror transistor providing a current load to a driver connected to the mirror transistor of the current mirror for operating a logic circuit in a static current mode offering lower power dissipation at high frequency clock rates and for providing stable output signal logic levels insensitive to operating conditions such as varying external radiation well suited for CMOS circuit operation.

17 Claims, 8 Drawing Sheets

Power Controlled Circuit

CMCMOS Current Mirror
With PMOS Mirror FET

CMCMOS Current Mirror
With NMOS Mirror FET

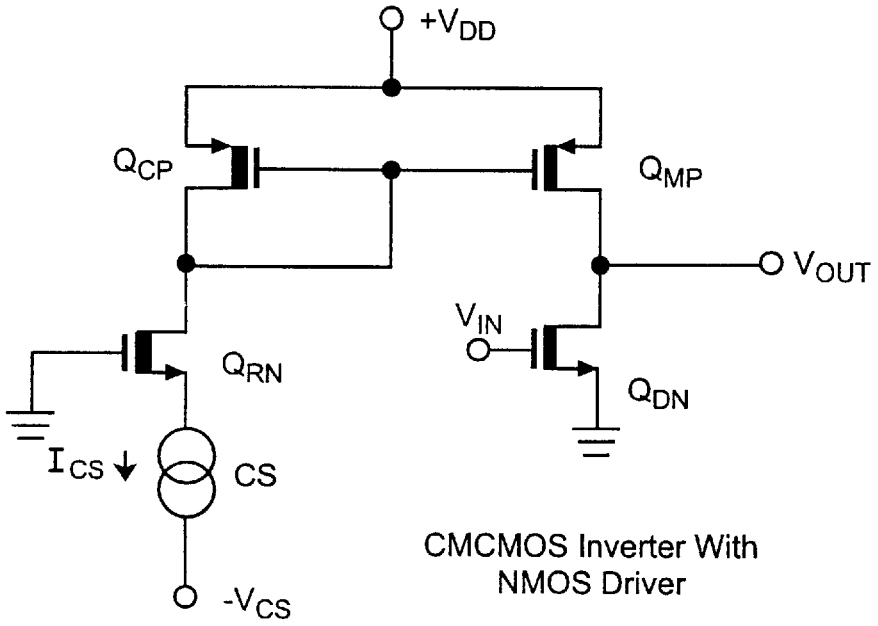
CMCMOS Inverter With NMOS Driver
FIG. 2A
CMCMOS Inverter With PMOS Driver
FIG. 2B
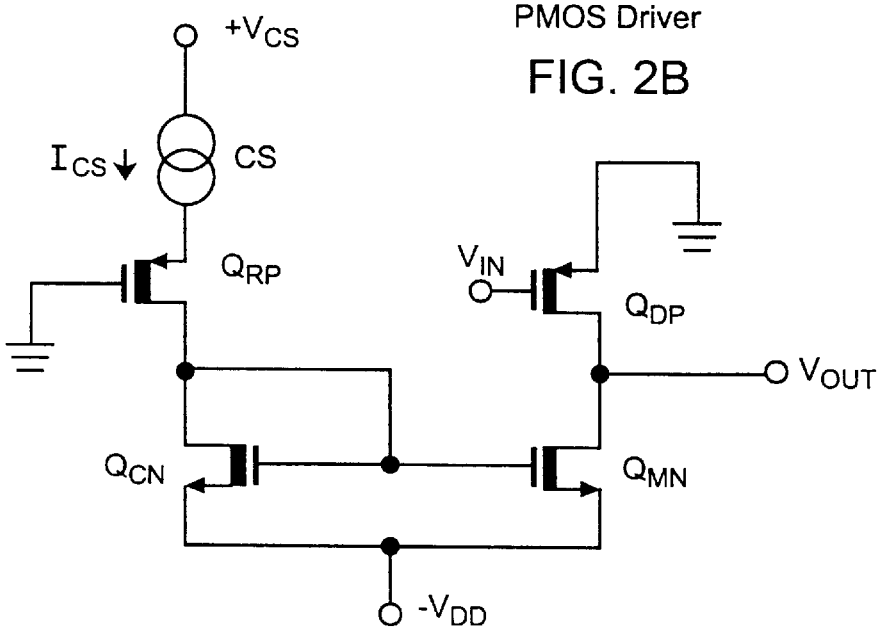

CMCMOS NOR Gate With
NMOS Driver

CMCMOS NOR Gate With
PMOS Driver

CMCMOS NAND Gate With NMOS Driver

CMCMOS NAND Gate With PMOS Driver

CMCMOS SRAM With NMOS Driver

CMCMOS SRAM With PMOS Driver

CMCMOS Ring Oscillator With NMOS Driver

CMCMOS Ring Oscillator With PMOS Driver

Power Controlled Circuit

CURRENT MODE TRANSISTOR CIRCUIT

STATEMENT OF GOVERNMENT INTEREST

The invention was made with Government support under Contract No. FO4701-93-C-0094 by the Department of the Air Force. The Government has certain rights in the invention. The invention described herein may be manufactured and used by and for the government of the United States for governmental purpose without payment of royalty therefor.

REFERENCE TO RELATED APPLICATION (1) The present application is related to applicant's co-pending application Ser. No. 08/883,223, filed Jun. 26, 1997, entitled Current Mode Transistor Circuit Control Method.

FIELD OF INVENTION

The present invention relates to field effect transistor (FET) circuits. More specifically, the present invention relates to complementary metal oxide silicon (CMOS) FET integrated circuits with controlled current mirrors.

BACKGROUND OF THE INVENTION

Complex digital systems can be built with the use of only a few simple logic circuits or gates, such as inverters, NAND gates and NOR gates. These logic gates are typically implemented as semiconductor integrated circuits (ICs). Each logic circuit or gate is similar in outline and geometry and consists of one or more output drivers driving one or more connected loads. The logic gate can be made using one of several conventional semiconductor processes and/or corresponding devices, such as a bipolar junction transistor, a junction field-effect transistor (JFET), or a metal oxide semiconductor field effect transistor (MOSFET). The driver of a logic gate is usually defined by variety of circuit specification and system parameters. Logic ICs may be grouped into families based on driver specifications. Consequently, bipolar ICs, JFET ICs, and MOS ICs logic families are well known by the driver specifications. The MOSFET is a widely used device for implementing logic gates. MOSFET ICs consist almost entirely of active MOSFET devices which are small, high input impedance, low power consumption and inherently isolated devices. The MOSFET manufacturing process has been refined to produce high yield ICs even at the very large-scale integration (VLSI) levels.

The MOSFETs have a drain to source current ID versus voltage VDS plot for enhancement-mode MOS transistors. Below saturation or pinch-off, the device operates as a non linear voltage controlled resistor in an operating region often called the ohmic region of the MOSFET. Beyond saturation the MOSFET behaves as a voltage controlled current source. An enhancement-mode MOSFET transistor remains in saturation when its gate is shorted to its drain so long the gate-source voltage exceeds the threshold voltage VT of the MOSFET. The ID vs. VDS characteristics make the enhancement-mode MOSFET well suited for implementation as a current mirror load.

The conventional configuration the MOSFET current mirror load consists of a first current enhancement mode MOSFET and a second enhancement-mode MOSFETs having the two gate inputs connected together so that the current in second mirror MOSFET mirrors the current in the first current MOSFET. The first current MOSFET is series connected to a current source CS having a reference current I.

Consequently, this same current I is conducted through second mirror MOSFET providing a current mirror load having a load current. The current source is typically implemented by a resistor.

The first current MOSFET which is series connected with the current source and operates in saturation when the VDS exceeds the threshold voltage VT as a result of the gate connected to the drain. When the first current MOSFET and the second mirror MOSFET are identical devices with identical geometries, then the second mirror MOSFET will also be in saturation as long as VDS is greater than or equal to VT. Under these circumstances, the drain current of the second mirror MOSFET is identical to the drain current of the first current MOSFET which is equal to the current I of the current source. The drain current of the second mirror MOSFET is considered a load current IL and is constant as long as the second mirror MOSFET remains in saturation. The current mirror is frequently used in ICs to reproduce current at one location to one or more other locations within a large interconnected integrated circuit. The current of first current MOSFET may be mirrored into several other second mirror MOSFETs. One current source and a respective current MOSFET may be connected to a plurality of mirror MOSFETs providing a respective plurality current mirror loads each having the current IL.

U.S. Pat. No. 4,670,671 entitled High Speed Comparator Having Controlled Hysteresis, discloses a CMOS analog circuit having resistive network comprising a resistive current source and a resistive current transistor for providing a bias voltage connected to two current transistors designated as current sources for an input differential stage and a feedback differential stage. The resistive network has an external control input VON for controlling the current on and off through the mirror transistors. Hence, the current mirror has a controlled current source connected to current transistor connected to a mirror transistors. The current of the mirror transistors that can be externally turned off and on. CMOS analog circuits have used CMOS current mirrors comprising a current source conducting the current I through a current transistor coupled to a mirror transistor conducting the same current as the current transistor and providing a high impedance current mirror load which when integrated into analog amplifiers, provide the amplifier with high gain.

The current mirror continuously conducts currents and as such continuously dissipates power during operation use. Current mirror loads have not been used in conventional CMOS logic circuits which do not dissipate power when in a stable logic state. Constant current loads are not used in logic circuit because high continuous power dissipation results when using constant current loads. Logic CMOS circuits use switching transistors which conduct current and dissipate power during transitions between one logic state to another. Conventional CMOS logic circuit are dynamic, in that, the CMOS logic circuits dissipate power only while charging or discharging the internal transistors and load capacitances as the output signal changes from one state to another state. During logic transitions when power dissipation is dynamic, the power dissipation disadvantageously increases as the frequency of operation increase. With increasing speeds of VLSI operation, dynamic CMOS logic circuits suffer from increased power dissipation. The use of a constant current load at very low level of current may seem to be an advantageous alternative of providing a current load for high impedance driver loads providing rapid switching. However, at very low current, variations of the threshold voltage of the transistors dramatically affects the constant current which may result in the failure of the logic circuit to maintain the proper output logic state.

Logic circuits provide output signal levels which correspond to digital bits one or zero. The ability to distinguish voltage levels determines when a signal is a binary zero or a binary one, and is essential for proper logic circuit operation. It is desirable to provide output signals which have output signal levels that do not vary over operating conditions. It is further desirable to provide low power operating conditions.

In CMOS logic circuits, the output voltage levels are a function of the threshold voltage VT of the FET transistors. An undesirable feature of MOSFETs is that when they are exposed to radiation, the threshold voltage VT of the devices shifts. This shift in VT affects the operation of MOS ICs, resulting in degraded circuit performance. It is well known that when NMOS devices undergo radiation, the VT tends to become less positive, while the VT of irradiated PMOS devices tends to become more negative. At some point of accumulated exposure to radiation, MOSFET devices would fail. Radiation protection options are disadvantageously limited when producing radiation hardened systems. Often, systems use radiation hardened processing methods and error-correction software to recover from failing devices affected by radiation.

The threshold voltage VT varies during operation when radiated by an external source, such as the sun. Device current levels may change due to the change in the threshold voltage. As the accumulated radiation increases, the threshold voltage of PMOS transistors increases as the threshold voltage of NMOS transistors decreases, affecting current and slowing the operation of the CMOS logic circuit through reduced capacitive charge currents. The affects of changing threshold voltages and resulting changes in operating current have rendered low current low power dissipating current mirror loads ineffective or undesirable in logic circuits. CMOS logic circuits disadvantageously suffer from varying output voltage signal levels and current levels when radiated, and have rendered ineffective the use very low current mirror loads for fast low power operation. These and other disadvantages are solved or reduced using the present invention.

SUMMARY OF THE INVENTION

An object of the invention is to provide a low current mirror load in a logic circuit for low power operation.

Another object of the invention is to provide a current mirror load in a logic circuit for operating the logic circuit in a current mode.

Yet another object of the invention is to provide a current mode logic circuit having a current mirror and output driver operating in a static current mode.

Still another object of the invention is to provide a logic circuit which is insensitive to external radiation.

Still a further object of the invention is to provide current mode logic circuits having output voltage signals that are insensitive to radiation.

Still another object of the invention is to provide a method for operating a logic circuit in a current mode.

Yet another object of the invention is to provide a method for controlling the current through a current mode logic circuit for controlled power operation.

Still another object of the invention is to provide a method for controlling the current through a current mode logic circuit for low power steady state operation or high power switching operation.

The present invention in a broad aspect is current mirror circuit preferably used in logic circuits. The current mirror comprises a current source CS conducting a source current ICS, a reference transistor QR and a current transistor QC connected in series conducting the source current Ics to which current transistor QC is connected one or more mirror transistors each of which provides a current mirror load having a load current IL. The current transistor QC is connected to the mirror transistor QM for establishing the load current IL in the mirror transistor QM providing a current mirror load. Preferably, the current transistor QC and the mirror transistors QM have identical geometries so that the load current IL in the mirror transistor is equal to the source current ICS through the current transistor QC. The source current ICS may be related to the current IL by differing transistor geometries. Preferably, the mirror transistor QM provides a current load to an output driver which in turn provides an output voltage signal VOUT. The reference transistor QR has a reference input voltage and is used to maintain operation of the current mirror to provide stable output signal voltage levels which are independent of the source current ICS or load current IL. The current mirror load provides current mode operation. The current mirror load is insensitive to changes in the threshold voltages so that the output voltage levels of the output voltage signal VOUT and currents ICS and IL are maintained during exposure of accumulated radiation. The current mirror load can be controlled to be operated at high current high power dissipation during switching operation and at low current low power dissipation during dormant operation, yet maintain the output voltage levels at the proper voltage levels.

In the preferred form, current mode (CM) logic circuits are complementary metal oxide silicon (CMOS) field effect transistors (FET) fabricated as integrated circuits (ICs). Current mode circuits and methods can be applied to a wide variety of IC fabrication processes, such as bipolar, JFET, NMOS, and PMOS processes. The preferred current mode CMOS (CMCMOS) logic family can include a wide variety of logic circuits, for examples, inverters, NOR gates, NAND gates, SRAM cells and ring oscillators. The CMCMOS logic family have output drivers that are preferably either n-channel MOSFET (NMOS) or p-channel MOSFET (PMOS) output drivers. In the CMCMOS logic circuit family, when the output driver has an n-channel MOSFET (NMOS) QN, then the current-mirror load is preferably an p-channel MOSFET (PMOS) mirror transistor QMP, and conversely, when the output driver has an p-channel MOSFET (PMOS) QP, then the current-mirror load preferably has an n-channel MOSFET (NMOS) mirror transistor QMN.

The CMCMOS logic circuits are static devices in that power is continuously dissipated as a consequence of the current mirror circuit. The mirror transistor QM conducts the load current IL as long as an output driver transistor QP or QN of the output driver is on. The continuous power dissipation of the CMCMOS circuit is not a large disadvantage in comparison with conventional CMOS circuits because of the high frequency clocking rates normally used by CMOS logic circuits. For example, when using standard 1.25 um design, the power dissipation of a conventional CMOS circuit having clock frequency in excess of 10.0 MHz typically exceeds the power dissipation of the same CMCMOS circuit having a 1.0 $\mu$A current source in the current mirror load. CMCMOS circuits have reduced power advantages when used in very high-speed frequency logic ICs. Preferably, the source current ICS and the load current IL is reduced by and externally controlled when the logic circuit is not switching, so as to reduce steady state power dissipation.

The CMCMOS logic circuits use the reference transistor QR to enable operation of the current source CS to maintain the output voltage levels at proper operating level even during very low current operation and during high accumulation of the radiation. The reference voltage is insensitive to external radiation because the output reference voltage is determined not by the threshold voltages of the current mirror transistors QR, QC and QM, but by an external voltage reference VR applied to the gate of reference transistor QR of the current mirror. These and other advantages will become more apparent from the following detailed description of the preferred embodiment.

BRIEF DESCRIPTION OF THE DRAWINGS

FIGS. 2*a* and 2*b* are schematics of CMCMOS inverters.

DETAILED DESCRIPTION OF THE PREFERRED EMBODIMENT

Figure 1A:
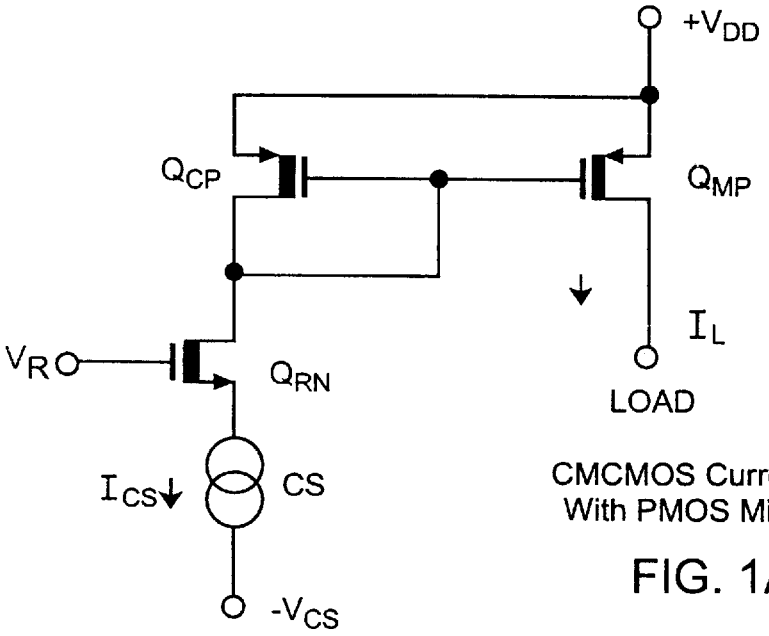
FIGS. 1*a* and 1*b* are schematics of CMCMOS current mirrors.
Figure 1B:
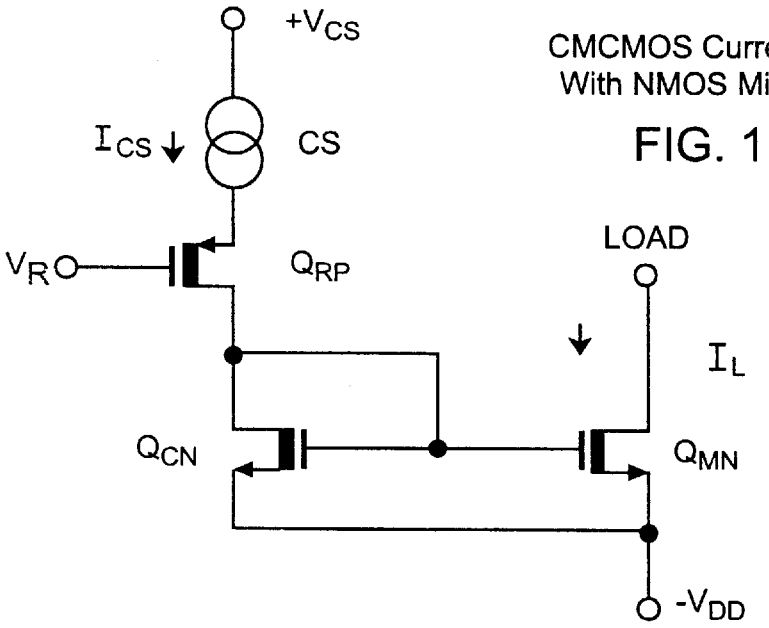

Referring to FIGS. 1*a* and 1*b,* respective p-channel metal oxide silicon (PmOS) transistor current mirror and n-channel metal oxide (NMOS) transistor current mirror each comprise a respective current source CS for establishing a source current ICS in the current mirrors between the voltage references, +VDD and −VCS, and +VCS and −VDD, respectively. The PMOS current mirror further comprises a reference PMOS transistor QRP, a current PMOS transistor QCP, and a mirror PMOS transistor QMP. The NMOS current mirror further comprises, a reference NMOS transistor QRN, a current NMOS transistor QCN, and a mirror NMOS transistor QMN. The mirror transistors QMN and QMP provide a current mirror load having a load current IL which is typically equal to the source current ICS because of similar transistor geometries. The PMOS and NMOS current mirrors provide a continuous load current IL at the current load of a drain terminal of the mirror transistors QMN and QMP, respectively, as a current mirror load. The reference transistors QRN and QRP have respective gates connected to a voltage reference VR, such as, a ground voltage reference. The reference voltage VR is preferably a reference voltage between the power supply references +VDD or −VCS, and +VCS or −VDD, respectively. The reference voltage VR may be provided in a variety of way, for examples, through a connection to a voltage reference such as a ground reference, or a connection to a resistor network which is in turn connected between the voltage references +VDD or −VCS, and +VCS or −VDD, respectively for to establishing the voltage reference VR.

The current mirrors may be connected to a variety of output driver circuits to form a respectively variety of logic circuits operating in a current mode (CM) operation. The current mirror, comprising a current source CS, a reference transistors QRN or QRP, also collectively referred to QR, a current transistor QCP or QCN, also collectively referred to as QC, may be connected to a respective plurality of mirror transistors QMP or QMN, also referred to as QM, for creating a plurality of current loads distributed throughout an integrated circuit. This plurality of current loads can be connected to a respective plurality of output drivers. This plurality of current loads are used to provide current mode operation to a respective plurality output drivers of logic gates preferably integrated onto a single integrated circuit (IC) chip.

The constant current mirror load is defined by the current mirror comprising the current source Cs, the reference transistor QR, the current transistor QC and the mirror transistor QM. The current source CS may be generated internal or provided external to integrated circuits, but is preferably integrated in the IC. Present IC technology is able to locate CS inside the chip, but having an external current source offers many advantages, one of which is the ability to externally change the load current dynamically at any time during the operation. The current source CS is preferably a resistor so that the source current ICS is insensitive to changes in threshold voltages VT. The current source CS may also be a depletion mode transistor.

Referring to FIG. 2*a* and 2*b,* the first CMCMOS inverter comprises the current mirror having the current source CS, and transistors QRN, QCP, QMP, and an NMOS output driver comprising an output driver transistor QDN, and the second CMCMOS inverter comprises the current mirror having the current source CS, the transistors QRP, QCN and QMN, and a PMOS output driver comprising a driver transistor QDP. In both CMCMOS inverter circuits, an input voltage signal VIN is applied to the gate of the driver transistor QDN and QDP, also collectively referred to as QD, providing an inverted output voltage signal VOUT, and the reference transistors QR have a ground reference voltage, as shown. For proper operation, the saturation current of the output driver transistors QD exceeds the load current IL established by the current mirror comprising CS, QR, QC and QM.

MOS transistors conduct current defined by the gate voltage and a threshold voltage VT. For the output transistor, QN or QP, the current $I=(\beta/2)(VIN-VT)^2$. The operation of the driver transistor QD connected to the current load of the mirror transistor QM, provide a VOUT to VIN transfer characteristic of the CMCMOS inverters. When VIN is less than VT, the driver transistor QD turns off and does not conduct current and VOUT is constant voltage level of VDD because the drain-source voltage of the QM is zero. When VIN is greater than VT, the driver transistor QD turns on to conduct current with the output voltage VOUT changing to VDD. When VIN substantially exceeds VT, then VOUT rapidly changes to VDD when the mirror transistor QM begins to leave saturation and begins to turn off. When the input voltage VIN is greater than the threshold VT of the driver transistor QD, the output driver transistor QD is on. When the current of output driver transistor QD exceeds the load current IL through the mirror transistor QM, then driver transistor QD operates in saturation and the output voltage VOUT of the inverter is approximately equal to the source terminal potential, which is shown as a ground reference. VIN represents logic level 1 when VIN is greater than VT, as a high gate voltage driving the driver transistor QD into saturation. When VIN is a logic 1, then VOUT is a logic 0, such as a low or ground voltage level. VIN represents logic 0 when VIN is less than VT, as a low gate voltage turning off the driver transistor QD. When VIN is a logic 0, then VOUT is a logic 1, such as a high or VDD voltage level. When the driver transistor QD turns off, VOUT increases to VDD representing a logic 1. Hence, if the input voltage VIN corresponds to logic level 0, such as a ground voltage level, then the output voltage VOUT of the inverter corresponds to logic level 1, such as a high VDD voltage level.

For MOS logic circuits as well as the CMCMOS inverters, the output driver transistor is preferably enhancement mode MOSFET because the enhancement mode MOS devices require gate and drain bias voltages of the same polarity, which allows for the direct coupling of consecutive stages.

The reference transistor QR enables the operation of the current mirror load at stabilized load current levels over wide variations of stabilized source current ICS without affecting the static voltage levels of the output voltage signal VOUT, even in the presence of external radiation which might affect the operation of the current source CS. The current source CS may have a threshold voltage which may change in the presence of the external radiation. For example, when the current source CS comprises a MOSFET transistor, the threshold voltage VT may change in the presence of radiation. The gate to source voltage of the reference transistor QR will vary as voltage across the current source CS varies, for example, in the presence of radiation, so as to maintain the source current IL. When the source current ICS is maintained, then the current mirror load will be driven to a constant level of load current IL so that the driver transistor QD will completely switch on when conducting the load current IL, or completely switch off, so that the output voltage signal VOUT will completely switch respectively, between the two output voltage levels, for example, ground when QD is on and +/−VDD when QD is off. The reference transistor QR enables the use of current mirror loads in logic circuits operating at low source current levels well suited for low power fast logic circuits. The current mode logic circuit does not slow down in switching speed nor consume more power in the presence of accumulated radiation because the level of the current load IL and the reference voltages +/−VDD remain constant during operation.

Figure 3A:
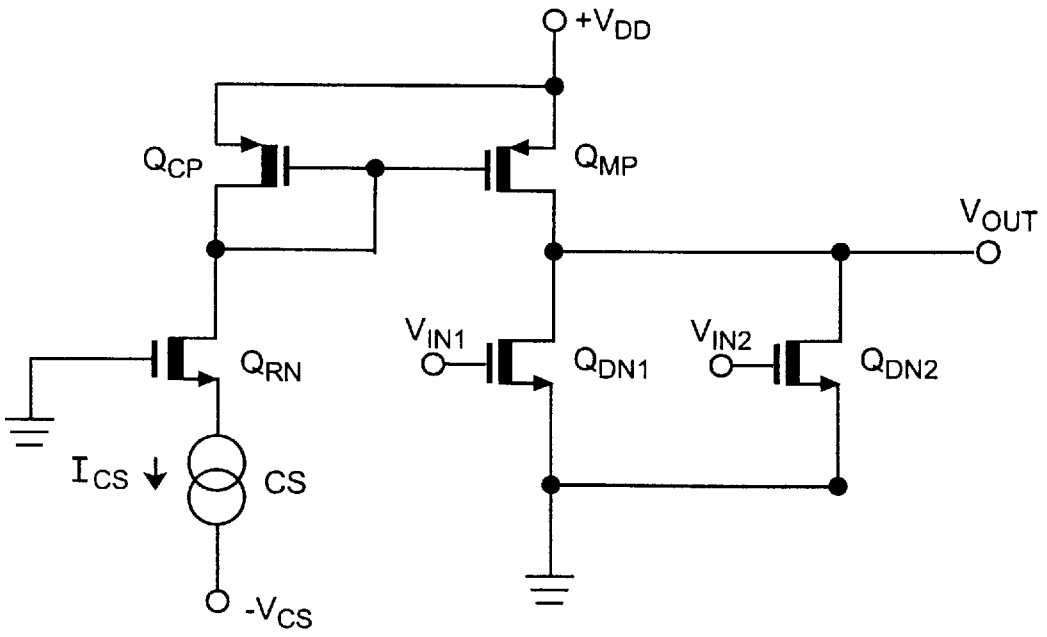
FIGS. 3*a* and 3*b* are schematics of CMCMOS NOR gates.
Figure 3B:
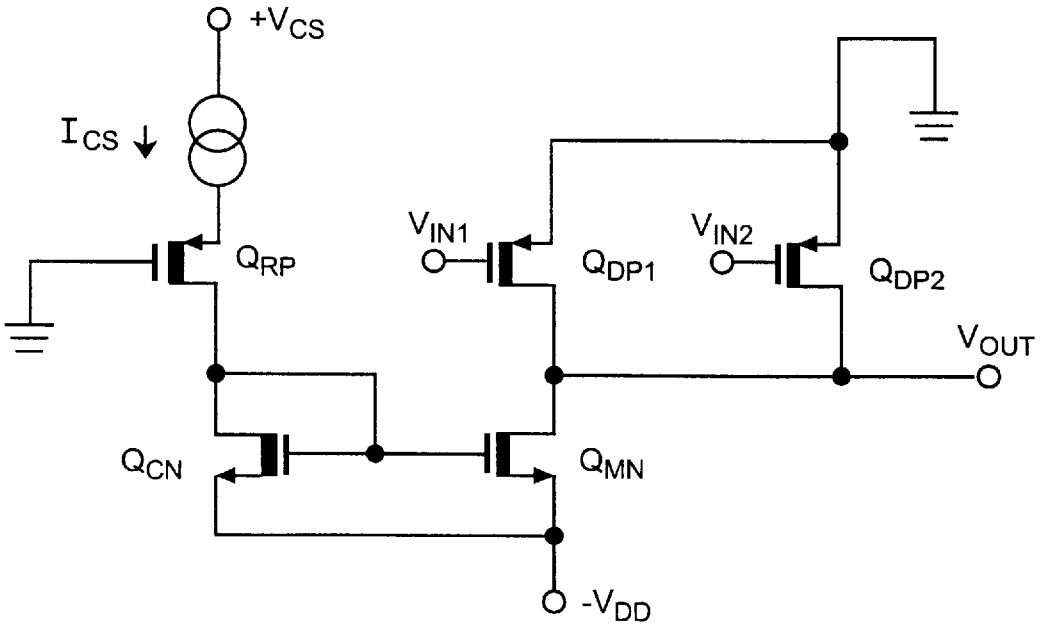

Referring to FIGS. 3*a* and 3*b,* the first CMCMOS NOR gate comprises the current mirror having the current source CS, and transistors QRN, QCP, QMP, and an NMOS output driver comprising output driver transistors QDN1 and QDN2, and the second CMCMOS NOR gate comprises the current mirror having the current source CS, the transistors QRP, QCN and QMN, and a PMOS output driver comprising two output driver transistors QDP1 and QDP2. In both CMCMOS NOR gate circuits, input voltage signals VIN1 and VIN2 are respectively applied to the gates of the driver transistors QDN1 and QDN2, or QDP1 and QDP2, providing an output voltage signal VOUT, and the references transistors QR have a ground reference voltage, as shown. For proper operation, the saturation current of either of driver transistors QD exceeds the load current IL established by the current mirror for an inverted output voltage signal VOUT.

Figure 4A:
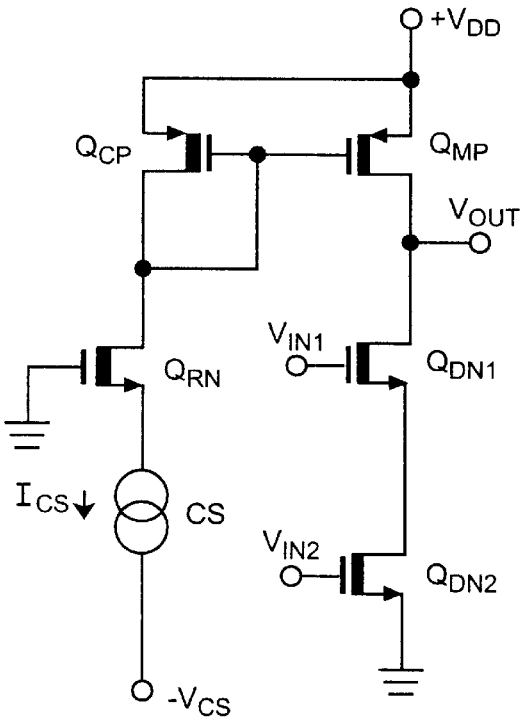
FIGS. 4*a* and 4*b* are schematics of CMCMOS NAND gates.
Figure 4B:
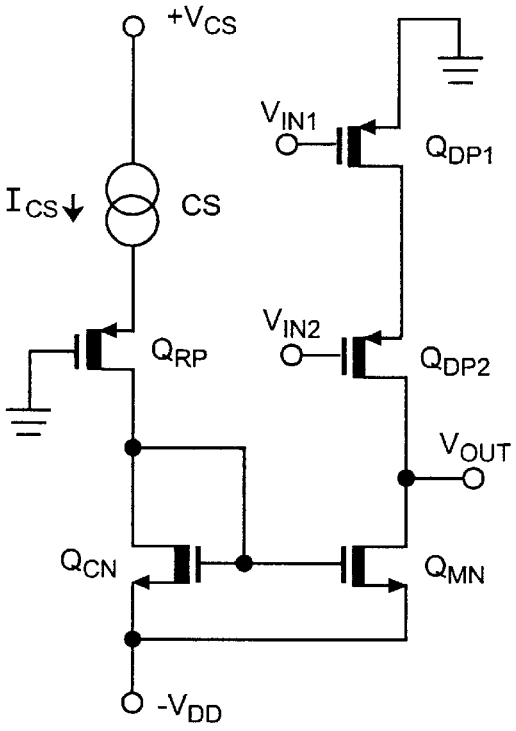

Referring to FIGS. 4*a* and 4*b,* the first CMCMOS NAND gate comprises the current mirror having the current source CS, and transistors QRN, QCP, QMP, and an NMOS output driver comprising output driver transistors QDN1 and QDN2, and the second CMCMOS NAND gate comprises the current mirror having the current source CS, the transistors QRP, QCN and QMN, and a PMOS output driver comprising two output driver transistors QDP1 and QDP2. In both CMCMOS NAND gate circuits, input voltage signals VIN1 and VIN2 are respectively applied to the gates of the driver transistors QDN1 and QDN2, and QDP1 and QDP2, providing an output voltage signal VOUT, and the references transistors QR have a ground reference voltage, as shown. The NAND gates operate by using multiple drivers transistors QD connected in series and both must be on to provide an inverted VOUT signal.

Figure 5A:
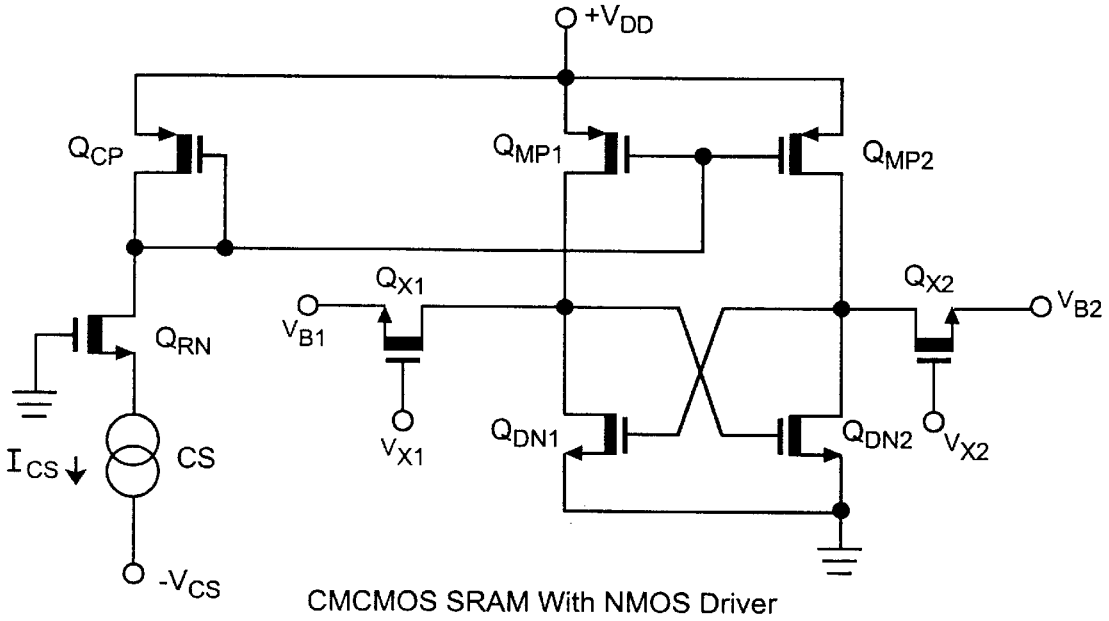
FIGS. 5*a* and 5*b* are schematics of CMCMOS SRAMs.
Figure 5B:
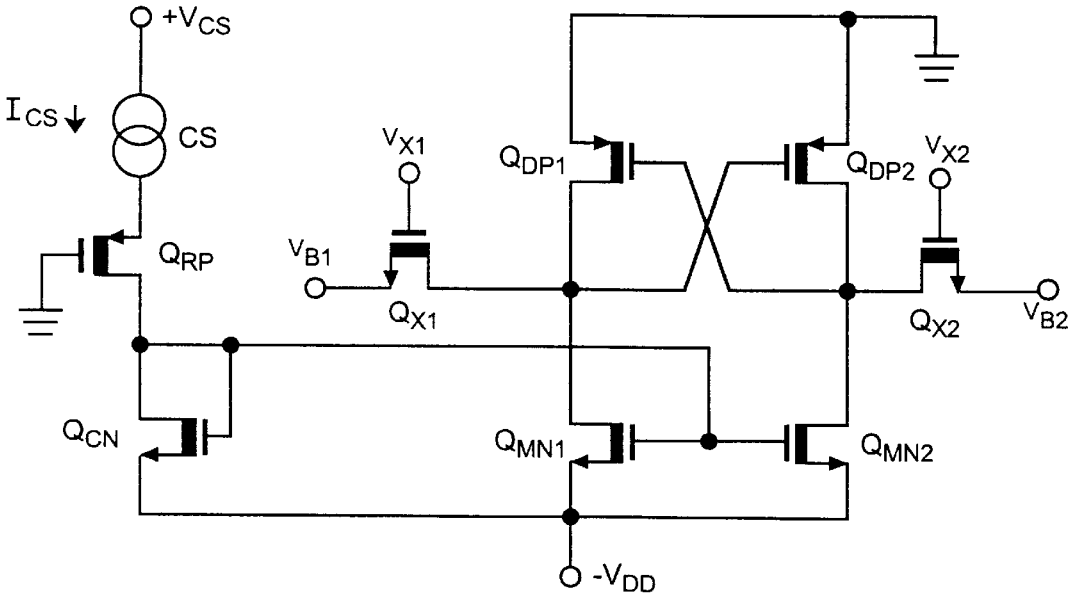

Referring to FIGS. 5*a* and 5*b,* the first CMCMOS static random access memory (SRAM) cell comprises the current mirror having the current source CS, transistors QRN and QCP, mirror transistors, QMP1 and QMP2, an NMOS output driver comprising output flip flop driver transistors QDN1 and QDN2, and transfer transistors QX1 and QX2 having respective control signals VX1 and VX2 for respectively coupling bit voltage signals VB1 and VB2 to the output flip flop driver transistors QDN1 and QDN2, and the second CMCMOS SRAM cell gate comprises the current mirror having the current source CS, reference transistor QRP, the current transistor QCN, and mirror transistor QMN1 and QMN2, a PMOS output flip flop driver comprising two output flip flop driver transistors QDP1 and QDP2, the transfer transistors QX1 and QX2 having the respective control signals VX1 and VX2 for respectively coupling the bit voltage signals VB1 and VB2 to output flip flop driver transistors QPD1 or QDP2. In both CMCMOS SRAM cell circuits, the references transistors QR have a ground reference voltage, as shown. The output driver transistor pairs QDN1 and QDN2, or QDP1 and QDP2, are cross connected so that one of the transistors is on and the other of off indicating the memory state of the SRAM cell. The control voltage signals VX1 and VX2 are used either sense or change the state the of output transistors QDN1 and QDN2, or QDP1 and QDP2, to and from the bit signals VB1 and VB2.

The SRAM cell provides a single bit of stored memory. Each series connected mirror transistor and driver transistor pair QMP1-QDN1, QMP2-QDN2, QMN1-QDP1 and QMN2-QDP2 form an inverter. In each SRAM cell, first and second inverters QMPl-QDN1 and QMP2-QDN2, or QMN1-QDP1 and QMN2-QDP2, are cross connected to form the memory cell. Transfer transistors QX1 and QX2 are respectively connected between respective bit signal VB1 and VB2 to the first and second inverters. In operation, the circuit pair of inverters can be set so that the output of one inverter is high and the output of the other inverter number is low, or vice-versa. For example, with QX1 and QX2 both on, with high VXl and VX2 voltages, and with VB1 high and VB2 low, the first inverter is driven high and the second low thereby setting the memory to this state, which may represent either a 1 or a 0.

Figure 6A:
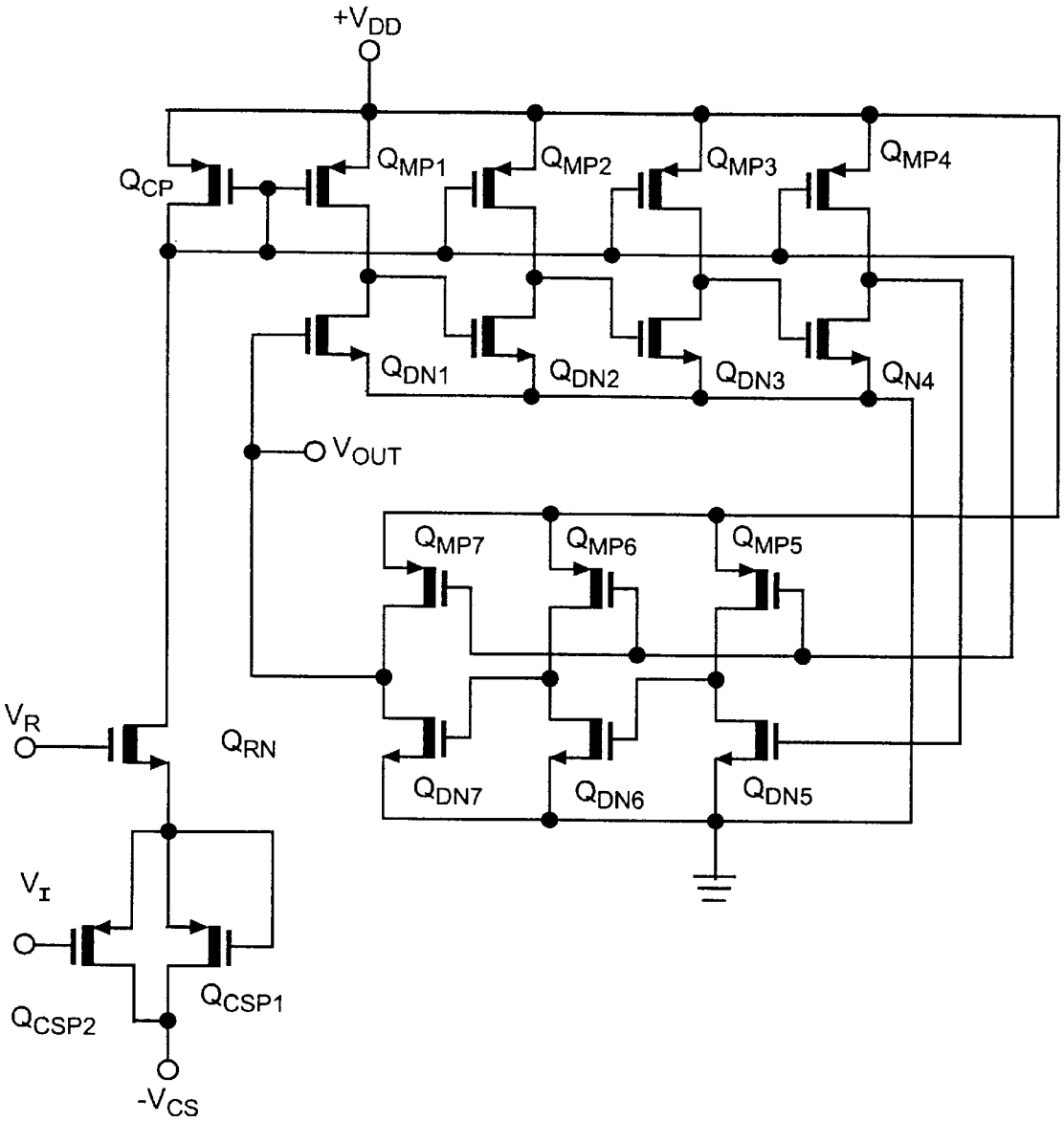
FIGS. 6*a* and 6*b* are schematics of CMCMOS ring oscillators.
Figure 6B:
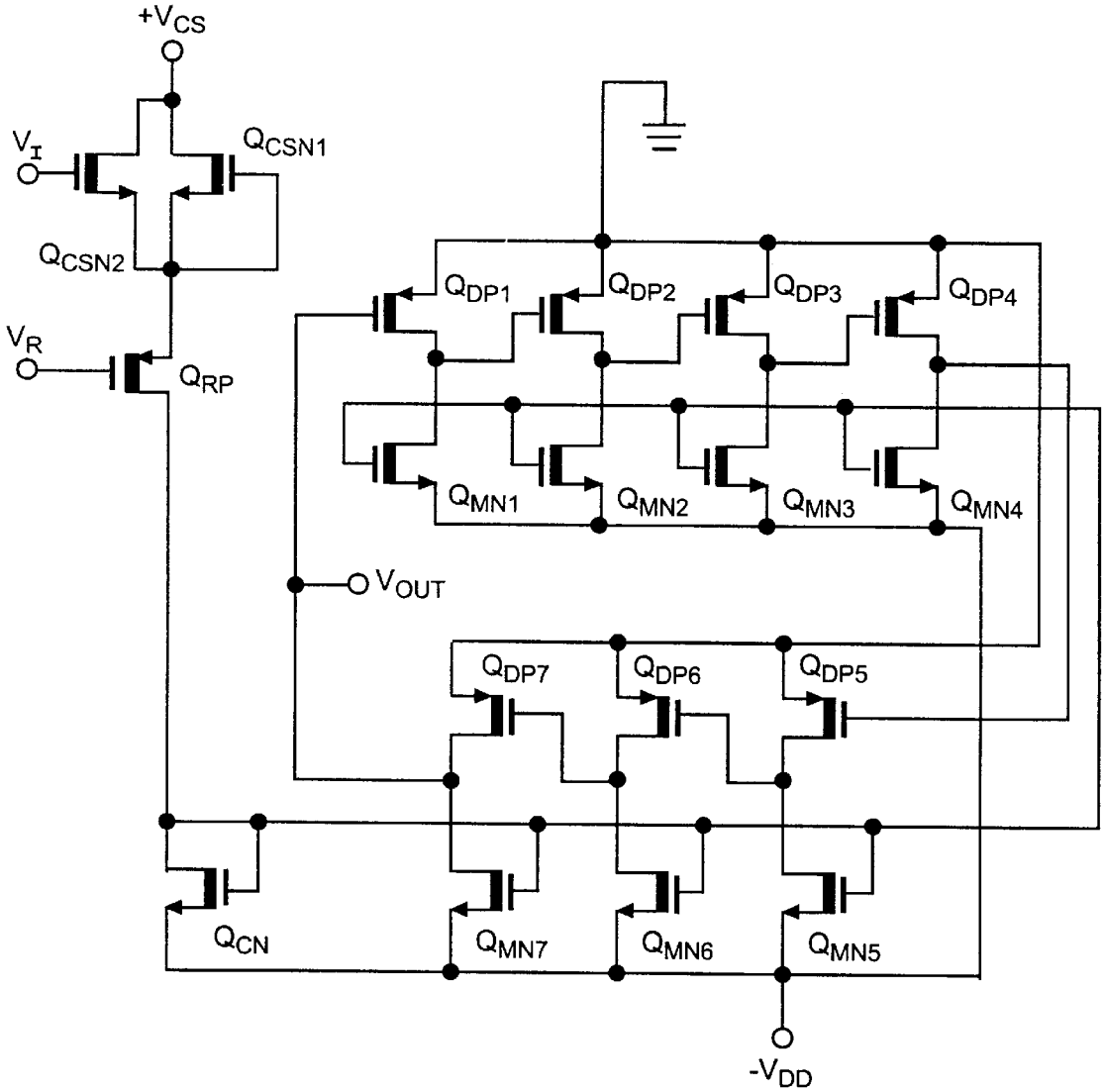

Referring to FIGS. 6*a* and 6*b,* the first seven stage ring oscillator comprises an externally controlled current source of transistors QCSP1 and QCSP2, the reference transistor QRN with an external reference voltage VR, a current transistor QCP and seven inverter transistor pairs of respective current transistors and driver transistors QMP1–7 and QDN1–7 coupled together in series to provide an oscillating output VOUT, and, the second seven stage ring oscillator comprises an externally controlled current source of transistors QCSN1 and QCSN2, the reference transistor QRP with an external reference voltage VR, a current transistor QCN and seven inverter transistor pairs of respective current transistors and driver transistors QMN1-7 and QDP1-7 coupled together in series to provide an oscillating output VOUT. In both oscillator circuits, the current sources CS each comprise two QSC transistors the second of which in controlled by an external current voltage signal VI. The signal VI is use to vary the current through the current source, and therefore the current through the reference transistors QR, and current transistors QC, to control the current through the mirror transistors QM, and therefore through the entire circuit. When VI is active, a larger current conducts through both transistors QCSN1–2, or QCSP1–2. When VI is inactive, a smaller current conducts through only the first transistor QCSN1 or QCSP1. Hence, the signal VI is used to control the amount of power dissipation in the circuits.

The controlled current source CS is preferably two resistors connected in series, the first of which has a parallel connected transistor QCS with an externally supplied gate voltage signal for conducting low current ICSO through both resistors when the transistor QCS is off, or for conducting high current ICS1 through the transistor QCS and the second resistor when the transistor QCS is on. There are a variety of resistor transistor networks that can be used to provide a variety of differing levels of source current ICS.

Figure 7:
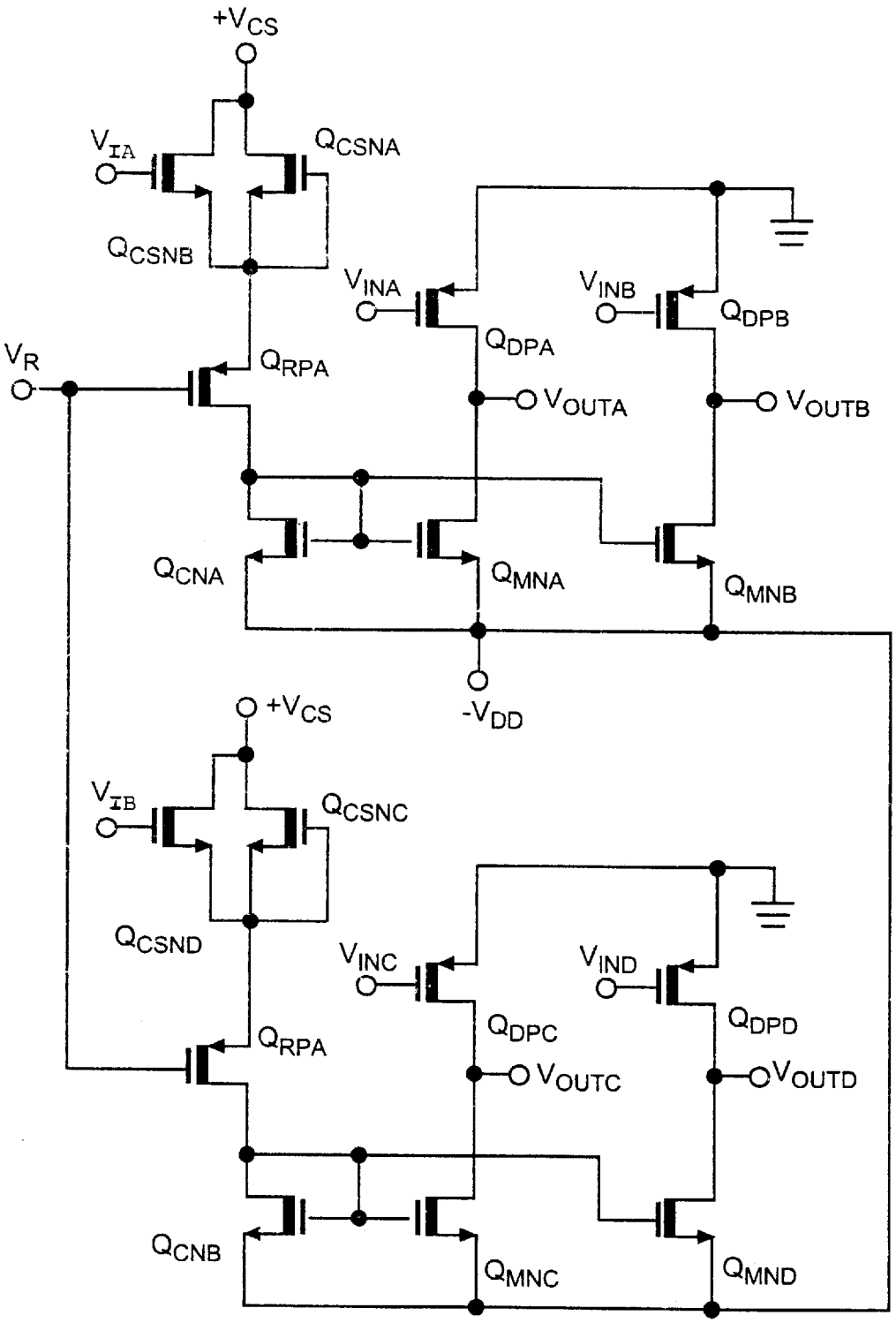
FIG. 7 is a schematic of a CMCMOS power controlled circuit.

Referring to FIG. 7, the power consumption of a power controlled circuit is controlled by two current sources designated by input signals VIA and VIB, comprising transistors QCSNA and QCSNB, and QCSNC and QCSND, respectively, conducting respective source currents through respective reference transistors QRPA and QRPB, respectively, to current transistors, QCNA and QCNB, each of which driving two mirror transistors QMNA and QMNB, and QMNC and QMND, respectively providing load currents to drive transistors QDPA and QDPB, and QDPC and QDPD, of logic circuits designated by respective inputs VINA and VINB, and VINC and VIND, and respective outputs VOUTA and VOUTB, and VOUTC and VOUTD. The drive transistors QDPA, QDPB, QDPC and QDPD function as a plurality of CMCMOS logic circuits, an exemplar one of which is shown in FIG. 2B, but with the logic circuits having a respective plurality of mirror transistors QMNA, QMNB, QMNC, and QMND functioning as a respective plurality of current mirrors. Each pair of current transistors QMNA and QMNB, and QMNC and QMND are a portion of the logic circuits and are respectively connected to current transistors QCNA and QCNB, respectively connected to current sources of current source transistor pairs QCSNA and QCSNB, and QCSNC and QCSND. Hence, the power controlled circuit comprises a plurality of current sources of VIA and VIB for respectively establishing load currents through respective portions of the plurality current mirrors conducting load currents through a respective plurality of logic circuits VINA-VOUTA, VINB-VOUTB, VINC-VOUTC, and VIND and VOUTD. During operational use, none, either one, or both of the VIA and or VIB current sources may be activated so that none, either pair of logic circuits VINA-VOUTA and VINB-VOUTB, or VINC-VOUTC and VIND-VOUTD, or both pairs may be active and consuming power to selectively control the power and to selectively provide the inverting logic functions. This exemplar configuration can be expanded to any number of current sources activating respective portions of the plurality of logic circuits.

The CMCMOS SRAM-cell has increased noise immunity because one of its driver transistors that is on forms a low-impedance node, therefore, the CMCMOS SRAM-cell is relatively insensitive to random noise spikes. The CMCMOS circuit also exhibits natural resistance to single event upsets. The single event upset resistance is the result of the resistance of the CMCMOS logic gates to transient upset or latch-up. The CMCMOS IC family is well suited for high reliability applications.

Current mode operation is not limited to the few exemplar circuits described. The operation of the CMCMOS logic circuits closely resembles that of the depletion-load NMOS logic family. The difference is that the depletion-load NMOS load device has been replaced by a current-mirror load device that results in the complementary the configuration of the CMCMOS circuit.

The current mode operation enables the use of an external current source CS for the current mirror operation. The current source can be implemented internally and can be externally controlled to allow the current mirror load to be changed dynamically at any time during operation.

When large IC systems are not in operation, it is customary to power down circuits to preserve power. This occurs often with large memory arrays. A reduction of the supply voltage is a power-down condition of a memory. In the case of CMCMOS memories, a power-down condition can be achieved by programming to control the CS current source through external control to a lower current value while keeping the supply voltage at its normal level. Thus, powering down of the CMCMOS circuits enable lower power dissipation without changing the operating conditions of the supply voltages. The CMCMOS circuit can be quickly restored to normal high power operating conditions by simply changing the VI input to the current source to its normal operating value without changing supply voltages which may take longer to stabilize and require additional complex circuits to control. The restoration of current source to its original current level is substantially instantaneous and returning the current source to its normal operating conditions does not require charging device capacitances because the supply voltage were maintained so that a power up sequence can be accomplished in one computer clock period. Additionally, a large memory can be subdivided into smaller segments each having its own current source. In this way, one segment of the memory may be powered down while another segment is not. A segment can be instantaneously powered up to access data when the data address is within the powered down segment. Since only a small segment of a large memory usually needs to be powered-up for normal operations, power requirements to large memories can be drastically reduced without any penalty in access speed.

It takes a certain amount of energy to change the logic state of a gate and the actual switching time is inversely proportional to the power consumed. The product of the delay time and power dissipation of a logic gate is referred to as a the speed-power product. There is usually a minimum delay speed-power product beyond which additional power must be consumed for increased speed. The speed-power product is relatively constant within an IC process technology. To reduce the energy needed for switching MOS-ICs, device dimensions are usually reduced. A unique feature of the CMCMOS logic family is that the delay time of a logic gate is not fixed. It can be varied during operation by simply increasing or decreasing the current through the current source and through the current mirror loads. This can be accomplished by increasing or decreasing the current of the current source using, for example, the preferred control signal VI. Changing the load current does not change the speed-power product of a CMCMOS gate. The speed-power product of the CMCMOS gate is relatively constant. By increasing the load current and consequently increasing the power consumed, the CMCMOS gate switches at faster speed. Hence, a system performance can be dynamically altered during operation to select the optimum power-speed operating condition.

The reference transistor QR and the current transistor QC are preferably enhancement-mode transistors. The enhancement mode MOSFET allows for direct coupling of consecutive stages. The enhancement mode MOSFETs remain in saturation when their gate and drain terminals are shorted when the gate-source or drain-source voltage exceeds the threshold voltage VT of the device. The gate and drain shorting connection provides a simple current mirror circuit connection. The enhancement mode MOSFET provides a wide range of source current ICS levels.

The operation of an enhancement mode MOSFET based current mirror is independent of the threshold voltage of reference transistor QR or current transistor QC. Using enhancement mode MOSFETs, the CMCMOS logic is well suited for applications in high-radiation environments, where accumulative radiation can shift the effective operating level of the threshold voltage VT. The operation of the CMOS current load is substantially independent of shifts in VT of the current source. Consequently, under radiation, only the shift in VT of the driver transistor QD influences the operation of CMCMOS gates. The shift in VT of the driver transistor has little effect in the operation of the CMCMOS circuit because the high and low voltage VIN and VOUT levels are substantially displaced from the VT level so that shifts in VT will not affect the operation of the circuit. CMCMOS circuits exhibit a natural radiation hardness. The gate switching operation using a load current IL is not affected by shifts in the VT of the current source.

The implementation of CMCMOS logic gates takes advantage of well established existing CMOS fabrication technology. A minor change in the CMOS interconnect and metalization outline patterns will convert most CMOS ICs into CMCMOS ICs. The new CMCMOS, logic family feature NMOS or PMOS driver transistors that have constant current loads. The current load of the driver transistors is established by a current mirror that converts a dynamic MOSFET circuit into a constant current load static circuit. The CMCMOS logic family enables improved methods by which an IC can be powered down in segments, and has an ability to vary the switching time during operation. The CMCMOS device also has inherent radiation hardness for radiation-hard systems. The present current mode circuit and method may be enhanced and modified but those enhancements and modifications may nonetheless fall within the spirit and scope of the following claims.

What is claimed is:

1. A current mirror circuit for providing a current mirror load providing a load current, the circuit comprising, a current source means for establishing a source current;

a reference transistor means connected to the current source means at a first terminal of the reference transistor means controlled by a reference voltage at a control terminal of the reference transistor means for providing a mirror voltage at a second terminal and for conducting the source current between the first and second terminal;

a current transistor means connected to the second terminal of the reference transistor means and controlled by the mirror voltage for conducting the source current; and a mirror transistor means connected to the current transistor means at a control terminal, the control terminal of the mirror transistor means also connected to the second terminal of the reference transistor means and controlled by the mirror voltage for providing the current mirror load conducting the load current, the reference voltage is for stabilizing the load current at a stabilized load current level.

2. The current mirror circuit of claim 1 wherein the reference transistor means, the current transistor means and the mirror transistor means are metal oxide silicon field effect transistors operated in a saturation mode.

3. The current mirror circuit of claim 1 wherein the current source means, the reference transistor means and the current transistor means are connected in series between a first supply voltage and a second supply voltage, and the voltage reference has a value between the first and second supply voltages.

4. The current mirror circuit of claim 1 wherein the reference transistor means, the current transistor means and the mirror transistor means are metal oxide silicon field effect transistors each having a gate terminal, and the gate terminals of the current transistor means and the mirror transistor means are connected together at the second terminal of the reference transistor means to receive the mirror voltage, the gate terminal of the reference transistor means is the control terminal.

5. The current mirror circuit of claim 1 wherein the current mirror load conducts the load current that is equal to the source current.

6. The current mirror circuit of claim 1 wherein the mirror transistor means is a plurality of mirror transistors, the current mirror load is a respective plurality of current mirror loads, and the load current is a respective plurality of load currents.

7. The current mirror circuit of claim 1 wherein the current source means is controlled by a current control signal for changing the source current between at least two source current levels for changing the load current between at least two load current levels.

8. The current mirror circuit of claim 1 further comprising an output driver transistor means connected between the current mirror load and the reference voltage for conducting the load current and for providing stabilized output voltage levels.

9. A circuit comprising, a current source means for establishing a source current;

a reference transistor means connected to the current source means at a first terminal of the reference transistor means and controlled by a reference voltage at a control terminal of the reference transistor means for providing a mirror voltage at a second terminal of the reference transistor means and for conducting the source current between the first and second terminal;

a current transistor means connected to the second terminal of the reference transistor means and controlled by the mirror voltage for conducting the source current, the current source means, the reference transistor means and the current transistor means are connected in series between a first supply voltage and a second supply voltage, and the voltage reference has a value between the first and second supply voltages; and a plurality of mirror transistor means connected to the current transistor means at control terminals and the control terminals of the plurality of mirror transistor means also connected to the second terminal of the reference transistor means and controlled by the mirror voltage for providing a respective plurality of current mirror loads for conducting a respective plurality of load currents; and a plurality of driver transistor means respectively connected to the plurality of the current mirror loads for respectively conducting the plurality of load currents, the plurality of driver transistor means each receive at least one input signal and each provide at least one output signal, the input and output signals are defined by two respective logic states by respective binary voltage levels between the first the second supply voltages, each of the at least one output signal is a respective logical function of the respective at least one input signal.

10. The circuit of claim 9 wherein the logical function is a memory function storing one of the two respective logic states of the respective at least one input signal.

11. A circuit comprising, a plurality of current source means for establishing a respective plurality of source currents;

a plurality of reference transistor means respectively connected to the plurality of current source means at a respective plurality of first terminals of the plurality of reference transistor means and controlled by a reference voltage at a respective plurality of control terminals of the plurality of reference transistor means for respectively providing a plurality of mirror voltages on a plurality of second terminals of the plurality of reference transistor means and for respectively conducting the plurality of source currents between the plurality of first terminals and the plurality of second terminals;

a plurality of current transistor means respectively connected to the plurality of reference transistor means at the plurality of second terminals and respectively controlled by the plurality of mirror voltages for respectively conducting the plurality of source currents, the respective plurality of current source means, the respective plurality of reference transistor means and the respective plurality of current transistor means are connected in series between a first supply voltage and a second supply voltage, and the voltage reference has a value between the first and second supply voltages; and a plurality of mirror transistor means respectively connected to the plurality of current transistor means at control terminals and the control terminals of the plurality of mirror transistor means also connected to the plurality of second terminals of the plurality of reference transistor means and respectively controlled by the plurality of mirror voltages for providing a plurality of current mirror loads for conducting a respective plurality of load currents; and a plurality of driver transistor means respectively connected to the plurality of the current mirror loads for respectively conducting the plurality of load currents, the plurality of driver transistor means each receive at least one input signal and each provide at least one output signal, the input and output signals are binary voltage signals defined by two respective logic voltage levels between the first the second supply voltages, each of the at least one output signal is a respective logical function of the respective at least one input signal.

12. The circuit of claim 11 wherein the reference voltage is ground;

the two supply voltages are VDD and VCS; and the two respective logic voltage levels are VDD and ground.

13. The circuit of claim 11 wherein, the plurality of reference transistor means, the plurality of current transistor means and the plurality of mirror transistor means are metal oxide silicon field effect transistors (MOSFETs) each having a gate terminal, and the gate terminals of the plurality of current transistor means and the plurality mirror transistor means are respectively connected together and to the plurality of second terminals of the plurality of reference transistor means to receive the respective plurality of mirror voltages, the gate terminals of the plurality of reference transistor means are the plurality of control terminals;

each of the plurality of the current source means are respectively controlled by a plurality of current control signals for respectively controlling the plurality of source currents;

each of the plurality of current source means comprise first and second MOSFETs connected together and respectively connected to the MOSFETs of the plurality of reference transistor means, the first and second MOSFETs of each of the plurality of current source means have drain terminals connected together and source terminals connected together, gate terminals of the first MOSFETs are respectively connected to the drain terminals continuously respectively conducting first currents, gate terminals of the second MOSFETs respectively receive the plurality of current control signals, the second MOSFETs are for respectively conducting second currents, the plurality of source currents respectively have first source current levels respectively equal to the first currents when the second MOSFETs are respectively controlled to be off and respectively have second source current levels respectively equal to the sum of the first and second currents when the second MOSFETs are respectively controlled to be on.

14. The circuit of claim 11 wherein a first portion of the plurality of current source means provide a respective first portion of the plurality of source currents at a first source current level for providing a respective first portion of the plurality of load currents at a first load current level to a respective first portion of the plurality of driver transistor means; and a second portion of the plurality of current source means provide a respective second portion of the plurality of source currents at a second source current level for providing a respective second portion of the plurality of load currents at a second load current level to a respective second portion of the plurality of driver transistor means.

15. The circuit of claim 14 wherein the logical function is a memory function for storing one of the two respective logic states of the input signal.

16. The circuit of claim 11 is a complementary metal oxide silicon integrated circuit wherein, the plurality of reference transistor means, the plurality of current transistor means, the plurality of mirror transistor means, and the plurality of drive transistor means are metal oxide silicon field effect transistors (MOSFETs) each having a gate terminal, and the gate terminals of the plurality of current transistor means and the plurality mirror transistor means are respectively connected together to receive the respective plurality of mirror voltages from the plurality of second terminals of the plurality of reference transistor means, the gate, source, and drain terminals of the plurality of reference transistor means are respectively the plurality of control, first and second terminals;

the plurality of reference transistor means comprise p-channel MOSFETS;

the plurality of current transistor means comprise n-channel MOSFETs;

the plurality of mirror transistor means comprise n-channel MOSFETs; and the plurality of driver transistor means comprise p-channel MOSFETs.

17. The circuit of claim 11 is a complementary metal oxide silicon integrated circuit wherein, the plurality of reference transistor means, the plurality of current transistor means, the plurality of mirror transistor means and the plurality of drive transistor means are metal oxide silicon field effect transistors (MOSFETs) each having a gate terminal, and the gate terminals of the plurality of current transistor means and the plurality mirror transistor means are respectively connected together to receive the respective plurality of mirror voltages from the plurality of second terminals of the plurality of reference transistor means, the gate, drain, and source terminals of the plurality of reference transistors respectively are the plurality of control, first and second terminals;

the plurality of reference transistor means comprise n-channel MOSFETS;

the plurality of current transistor means comprise p-channel MOSFETs;

the plurality of mirror transistor means comprise p-channel MOSFETs; and the plurality of driver transistor means comprise n-channel MOSFETs.

* * * * *